US011255592B2

(12) United States Patent
Wang et al.

(10) Patent No.: US 11,255,592 B2
(45) Date of Patent: Feb. 22, 2022

(54) AIR DUCT ASSEMBLY AND AIR COOLING REFRIGERATOR HAVING SAME

(71) Applicant: HAIER SMART HOME CO., LTD., Shandong (CN)

(72) Inventors: Ning Wang, Qingdao (CN); Shufei Ren, Qingdao (CN); Meng Wang, Qingdao (CN); Falin Yang, Qingdao (CN)

(73) Assignee: HAIER SMART HOME CO., LTD., Qingdao (CN)

( * ) Notice: Subject to any disclaimer, the term of this patent is extended or adjusted under 35 U.S.C. 154(b) by 0 days.

(21) Appl. No.: 16/968,476

(22) PCT Filed: Feb. 2, 2019

(86) PCT No.: PCT/CN2019/074622
§ 371 (c)(1),
(2) Date: Aug. 7, 2020

(87) PCT Pub. No.: WO2019/154377
PCT Pub. Date: Aug. 15, 2019

(65) Prior Publication Data

US 2020/0400362 A1 Dec. 24, 2020

(30) Foreign Application Priority Data

Feb. 8, 2018 (CN) ..... 201810130313.7

(51) Int. Cl.
*F25D 11/02* (2006.01)
*F25D 17/06* (2006.01)
(Continued)

(52) U.S. Cl.
CPC ..... *F25D 11/02* (2013.01); *F25D 17/065* (2013.01); *F25D 17/045* (2013.01);
(Continued)

(58) Field of Classification Search
CPC ..... F25D 29/00; F25D 17/065; F25D 23/00; F25D 25/02; F25D 17/04; F25D 11/02;
(Continued)

(56) References Cited

U.S. PATENT DOCUMENTS 3,600,905 A * 8/1971 Dymek ..... F25D 17/065 62/132
3,793,847 A 2/1974 Scarlett et al.
(Continued)

FOREIGN PATENT DOCUMENTS

CN 1752679 A 3/2006
CN 101082460 A 12/2007
(Continued)

OTHER PUBLICATIONS

International Search Report for PCT/CN2019/074622 dated Apr. 25, 2019 (4 pages).
(Continued)

*Primary Examiner* — Frantz F Jules
*Assistant Examiner* — Martha Tadesse
(74) *Attorney, Agent, or Firm* — Alston & Bird LLP

(57) ABSTRACT

An air duct assembly is provided that is configured to supply air to a compartment and including: an outer cover housing, configured to be fixed to an outer side of a compartment wall defining the compartment, an external accommodating cavity being defined inside the outer cover housing; an inner cover housing, configured to be disposed opposite to the outer cover housing on an inner side of the compartment wall, an internal accommodating cavity being defined inside the inner cover housing. An air inlet is formed in the outer cover housing, so as to allow external air to enter the external accommodating cavity via the air inlet. A vent is formed in the compartment wall, so that the external accommodating cavity communicates with the internal accommo-
(Continued)

dating cavity. An air outlet is formed in the inner cover housing, so as to supply the air in the internal accommodating cavity to the inside of the compartment.

9 Claims, 13 Drawing Sheets

(51) Int. Cl.
*F25D 17/04* (2006.01)
*F25D 25/02* (2006.01)
*F25D 29/00* (2006.01)

(52) U.S. Cl.
CPC ..... *F25D 25/025* (2013.01); *F25D 29/005* (2013.01); *F25D 2317/067* (2013.01)

(58) Field of Classification Search
CPC ..... F25D 2317/0663; F25D 17/045; F25D 25/025; F25D 2317/0666; F25D 2317/067; F25D 2317/0411; F25D 29/005
See application file for complete search history.

(56) References Cited

U.S. PATENT DOCUMENTS

| | | | | |
|---|---|---|---|---|
| 4,722,208 | A | 2/1988 | Frohbieter | |
| 5,495,726 | A | 3/1996 | Lee | |
| 2004/0144127 | A1 | 7/2004 | Jeong | |
| 2008/0196440 | A1 | 8/2008 | Kang | |
| 2012/0228786 | A1* | 9/2012 | Wang | A23B 7/148 261/78.2 |
| 2012/0304667 | A1* | 12/2012 | Shin | F25D 11/025 62/3.6 |
| 2016/0356538 | A1* | 12/2016 | Park | F25D 25/025 |
| 2016/0370105 | A1* | 12/2016 | Park | F25D 25/025 |
| 2017/0350634 | A1* | 12/2017 | Boarman | F25D 11/02 |
| 2018/0051924 | A1* | 2/2018 | Zhang | F25D 17/065 |
| 2020/0400362 | A1* | 12/2020 | Wang | F25D 29/00 |
| 2020/0400364 | A1* | 12/2020 | Wang | F25D 17/042 |

FOREIGN PATENT DOCUMENTS

| | | | | | |
|---|---|---|---|---|---|
| CN | 101131302 | A | | 2/2008 | |
| CN | 102393116 | | * | 3/2012 | |
| CN | 102393116 | A | | 3/2012 | |
| CN | 203053113 | U | | 7/2013 | |
| CN | 104567187 | | | 4/2015 | |
| CN | 104896842 | A | | 9/2015 | |
| CN | 204612302 | U | | 9/2015 | |
| CN | 107024064 | A | | 8/2017 | |
| CN | 107477948 | A | | 12/2017 | |
| DE | 10356963 | A1 | | 7/2004 | |
| EP | 3109581 | A3 | * | 3/2017 | F25D 25/025 |
| JP | 63 129284 | A | | 6/1988 | |
| KR | 100259920 | B1 | | 6/2000 | |
| KR | 20030065772 | A | | 8/2003 | |
| WO | WO-2016082533 | A1 | * | 6/2016 | F25D 11/02 |

OTHER PUBLICATIONS

Written Opinion for PCT/CN2019/064622 dated Apr. 25, 2019 (3 pages).
1st Search Report for Appln No. CN-201810130313.7 dated Nov. 27, 2019 (3 pages).
1st Office Action for Appln No. CN-201810130313.7 dated Dec. 30, 2019 (6 pages).
Supplementary European Search Report for EP Application No. 19750685 dated Feb. 12, 2021.

* cited by examiner

AIR DUCT ASSEMBLY AND AIR COOLING REFRIGERATOR HAVING SAME

CROSS-REFERENCE TO RELATED APPLICATIONS

The present application is a national phase entry of International Application No. PCT/CN2019/074622, filed Feb. 2, 2019, which claims priority to Chinese Patent Application No. 201810130313.7, filed Feb. 8, 2018, which are incorporated herein by reference in their entirety.

FIELD OF THE INVENTION

The present invention relates to the technical field of air supply devices, and more particularly relates to an air duct assembly and an air-cooled refrigerator with the same.

BACKGROUND OF THE INVENTION

With the consumer's expectation on a healthier lifestyle, the proportion of dry food materials, such as wolfberries, tea, mushrooms, longan and ophiocordyceps sinensis, gradually increases in the diet structure. However, these dry food materials are very difficult to store, and need to be placed and stored in a special drying chamber in a refrigerating chamber of a refrigerator. An existing drying chamber assembly occupies a large volume of the refrigerator and an additional air duct assembly is needed to supply air to the drying chamber assembly controllably, so as to ensure proper air circulation in a located space of the dry food materials, so that a space in the refrigerating chamber of the refrigerator cannot be effectively utilized. How to meet long-term storage requirements of special objects and reduce the influence on the existing volume of the refrigerator as much as possible simultaneously is a problem to be solved.

BRIEF DESCRIPTION OF THE INVENTION

An objective of the present invention is to provide an air duct assembly with a simple structure by aiming at defects in the prior art. A further objective of the present invention is to provide an air-cooled refrigerator with the air duct assembly.

Particularly, the present invention provides an air duct assembly, configured to supply air to a compartment. The air duct assembly includes:

an outer cover housing, configured to be fixed to an outer side of a compartment wall defining the compartment, an external accommodating cavity being defined inside the outer cover housing; and an inner cover housing, configured to be disposed opposite to the outer cover housing on an inner side of the compartment wall, an internal accommodating cavity being defined inside the inner cover housing.

An air inlet is formed in the outer cover housing, so as to allow external air to enter the external accommodating cavity via the air inlet.

A vent is formed in the compartment wall, so that the external accommodating cavity communicates with the internal accommodating cavity.

An air outlet is formed in the inner cover housing, so as to supply the air in the internal accommodating cavity to the inside of the compartment.

Optionally, the outer cover housing has a side wall provided with the air inlet and a side peripheral wall vertically extending from a peripheral side edge of the side wall. The outer cover housing is configured to shield the vent from the outer side of the compartment wall.

The projection of an outer surface of the side peripheral wall on a located plane of the compartment wall is positioned beyond the vent. The projection of an inner surface of the side peripheral wall on the located plane of the compartment wall falls in the vent.

Optionally, the air duct assembly further includes:

a damper assembly, disposed inside the outer cover housing, so as to communicate or block an air supply path from the air inlet to the vent controllably. The damper assembly includes:

a damper framework, disposed in the external accommodating cavity; and a rotating damper, pivotally installed on an inner side of the damper framework, and configured to controllably rotate to an open position so as to communicate the air supply path from the air inlet to the vent, and controllably rotate to a closed position so as to block the air supply path from the air inlet to the vent.

Optionally, the outer cover housing has a separation portion protruding and extending from the side wall to the compartment wall, so as to separate the external accommodating cavity into an electric cavity positioned at an upper portion and an air supply cavity positioned at a lower portion.

The damper framework is configured to be embedded and installed in the air supply cavity. The air inlet is disposed in a position of the compartment wall opposite to the air supply cavity.

The damper assembly is an electric control damper assembly. An electric control device in the electric control damper assembly is disposed in the electric cavity.

Optionally, the air duct assembly is disposed on the compartment wall positioned at a transverse side portion of the compartment.

The inner cover housing has an air guide plate cover portion disposed corresponding to the outer cover housing, and an air outlet cylinder portion perpendicular to the air guide plate cover portion and extending from a back end of the air guide plate cover portion to a middle portion of a back side of the compartment.

The air outlet is formed in a front side of the air outlet cylinder portion, so that air in the internal accommodating cavity flows forward via the air outlet to enter the compartment.

Optionally, a drawer body is disposed in the compartment, so as to accommodate an object to be stored in the compartment, and is configured to be pulled out of or pushed into the compartment controllably.

An airflow inlet is formed in a back plate of the drawer body and configured to be right aligned with and abut against the air outlet when the drawer body is completely pushed into the compartment.

Optionally, the drawer body has an upward top opening.

A drawer upper cover is disposed above the drawer body, so as to seal the top opening when the drawer body is completely pushed into the compartment.

Optionally, the air duct assembly further includes:

a first sealing strip, configured to be in an annular shape and disposed at an edge of the air guide plate cover portion, so as to seal a gap between the inner cover housing and the compartment wall; and a second sealing strip, configured to be in an annular shape and disposed on an outer side of the inner cover housing along an edge of the air outlet, so as to seal a gap between the airflow inlet and the air outlet when the drawer body is completely pushed into the compartment.

Optionally, an air inlet grille is disposed at a back portion of the drawer body and configured to cover and be buckled on an inner side of the airflow inlet in a manner of protruding toward the inside of the drawer body.

The present invention further provides an air-cooled refrigerator, including a freezing chamber, a refrigerating chamber, and the air duct assembly according to any one of the above. The refrigerating chamber is a compartment. The air duct assembly is disposed on a compartment wall positioned at a transverse side portion of the refrigerating chamber.

The air-cooled refrigerator further includes a drying chamber assembly disposed in a lower portion space inside the refrigerating chamber. The drying chamber assembly includes a drawer body configured to store an object to be stored and having an upward opening, and a drawer upper cover disposed above the drawer body.

The drawer body is configured to be pulled out of or pushed into the refrigerating chamber controllably, and the drawer upper cover seals the opening when the drawer body is completely pushed into the refrigerating chamber.

An airflow inlet is formed in a back plate of the drawer body and configured to be right aligned with and abut against an air outlet when the drawer body is completely pushed into the refrigerating chamber.

An air inlet is configured to communicate with the freezing chamber controllably, so as to controllably supply a cooling airflow in the freezing chamber to the drying chamber assembly positioned inside the refrigerating chamber via the air duct assembly.

The air duct assembly of the present invention does not need to be attached to an additional auxiliary structure, and may be conveniently and quickly installed on any plate body provided with an airflow through hole. Further, the air duct assembly may be installed in any position of any compartment following the plate body, and may supply an external airflow to the compartment.

These and other objectives, advantages and features of the present invention will become more apparent to those skilled in the art from the following detailed description of specific embodiments of the present invention in conjunction with the accompanying drawings.

BRIEF DESCRIPTION OF THE DRAWINGS

Some specific embodiments of the present invention will be described in detail hereinafter in way of example and not by way of limitation with reference to the accompanying drawings. The same reference numerals in the drawings indicate the same or similar components or parts. It should be understood by those skilled in the art that these drawings are not necessarily drawn to scale. In the drawings.

DETAILED DESCRIPTION

Figure 1:
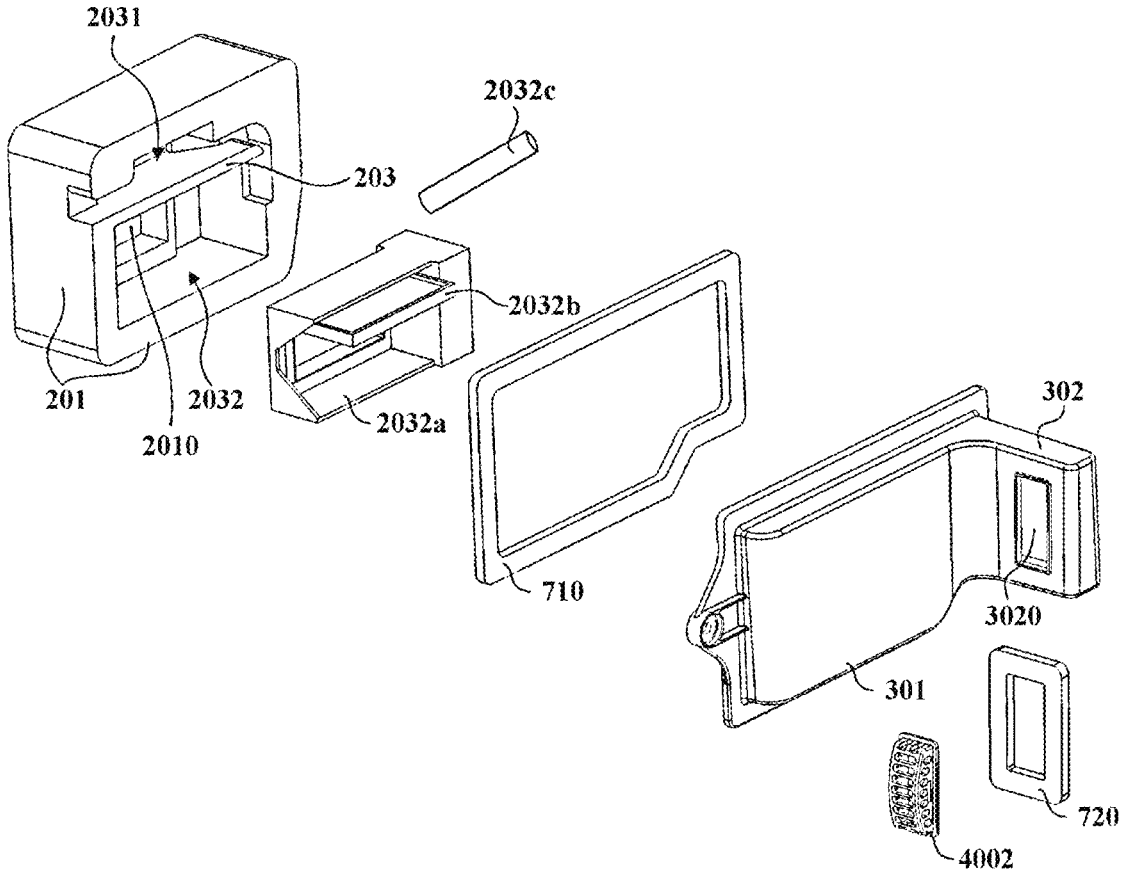
FIG. 1 is a schematic exploded view of an air duct assembly according to an embodiment of the present invention.
Figure 2:
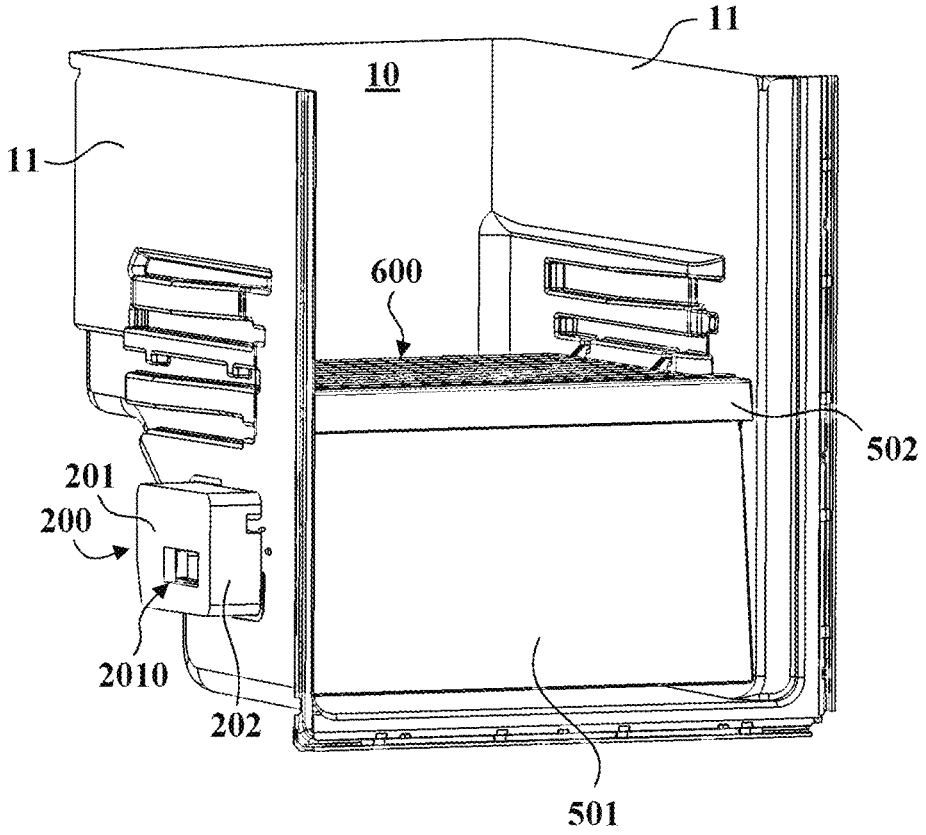
FIG. 2 is a schematic perspective view of a compartment provided with an air duct assembly and a drying chamber assembly according to an embodiment of the present invention.

FIG. 1 is a schematic exploded view of an air duct assembly according to an embodiment of the present invention. FIG. 2 is a schematic perspective view of a compartment provided with an air duct assembly and a drying chamber assembly according to an embodiment of the present invention.

The air duct assembly configured to supply air to a compartment may include an outer cover housing 200 and an inner cover housing 300. The outer cover housing 200 is configured to be fixed to an outer side of a compartment wall 11 defining the compartment, and an external accommodating cavity is defined inside the outer cover housing 200. The inner cover housing 300 is configured to be disposed opposite to the outer cover housing 200 on an inner side of the compartment wall 11, and an internal accommodating cavity is is defined inside the inner cover housing 300. The compartment may be a storage compartment for storing an object or other compartments requiring controlled ventilation.

Further, an air inlet 2010 may be formed in the outer cover housing 200, and configured to communicate with an external environment controllably, so as to allow air in the external environment to enter the external accommodating cavity via the air inlet 2010. A vent 123 may be formed in the compartment wall 11, so that the external accommodating cavity communicates with the internal accommodating cavity. An air outlet 3020 may be formed in the inner cover housing 300, so as to supply the air in the internal accommodating cavity to the inside of the compartment. That is, the outer cover housing 200 and the inner cover housing 300 which define a part of an air supply space are respectively disposed at the inner side and the outer side of the compartment wall 11.

The air duct assembly of the present invention does not need to be attached to an additional auxiliary structure, and may be conveniently and quickly installed on any plate body provided with an airflow through hole. Further, the air duct assembly may be installed in any position of any compartment following the plate body, and may supply an external airflow to the compartment.

Specifically, in some embodiments, the outer cover housing 200 has a side wall 201 provided with the air inlet 2010 and a side peripheral wall 202 vertically extending from the peripheral side edge of the side wall 201. The outer cover housing 200 is configured to shield the vent 123 from the outer side of the compartment wall 11. The projection of the outer surface of the side peripheral wall 202 on the located plane of the compartment wall 11 is positioned beyond the vent 123. The projection of the inner surface of the side peripheral wall 202 on the located plane of the compartment wall 11 falls in the vent 123.

That is, the side peripheral wall 202 of the outer cover housing 200 has a certain thickness, so as to press and cover an internal region and an external region of the vent 123 at the same time. Therefore, sealing effects between the side peripheral wall 202 and the compartment wall 11 are ensured, and the compartment wall 11 is prevented from being exposed on a flowing path from the external accommodating cavity to the internal accommodating cavity. The compartment wall 11 is further prevented from being impacted by the airflow.

The outer cover housing 200 and the inner cover housing 300 of the prevent invention configured to form the air duct assembly are correspondingly disposed on two sides of the same plate body respectively, so that the integral structure of the air duct assembly is more compact, and a required installing space is smaller. At the same time, the air duct assembly of the prevent invention may further avoid direct impact of the transmitted airflow on the plate body.

Due to the above structure characteristics, such a special structure of the air duct assembly of the present invention is applicable to various storage devices requiring a controlled circulation airflow, and is particularly applicable to supply of an airflow to an independent sub compartment (such as a drying chamber) inside an air-cooled refrigerator (which will be illustrated in detail hereafter).

The present invention further provides an air-cooled refrigerator with the above air duct assembly. Specifically, the air-cooled refrigerator may generally include a refrigerating chamber 10*a* and a freezing chamber 10*b*. A refrigerating chamber door 10*a*' and a freezing chamber door 10*b*' are respectively disposed at front openings of the refrigerating chamber 10*a* and the freezing chamber 10*b*, and are configured to respectively open or close the refrigerating chamber 10*a* and the freezing chamber 10*b*. The refrigerating chamber 10*a* may be disposed adjacent to the freezing chamber 10*b* in a lateral direction. Or the refrigerating chamber 10*a* is disposed in the lateral direction of the refrigerating chamber 10*b*. A separation plate is disposed between the refrigerating chamber 10*a* and the freezing chamber 10*b*. The separation plate may be composed of a compartment wall 11 positioned on the side of the refrigerating chamber 10*a*, a compartment wall positioned on the side of the freezing chamber 10*b*, and a foaming layer between the compartment walls.

As will be appreciated by those skilled in the art, the air-cooled refrigerator according to the embodiment of the present invention may further include a refrigerating circulation system and an air duct. The refrigerating circulation system, for example, may include a compressor, a condenser, a throttle element and an evaporator. The air-cooled refrigerator may be further provided with a fan 12 positioned in the air duct. The fan 12 is configured to blow an airflow subjected to temperature reduction and dehumidification through the evaporator to the refrigerating chamber 10*a* and/or the freezing chamber 10*b*.

Further, a drying chamber 40 composed of a drying chamber assembly and having an independent drying space may be disposed in a lower portion space of the refrigerating chamber 10*a*. The drying chamber 40 has the following drying principle: after air cooled by a cooling source is supplied into a relatively high-temperature sealed environment, along with gradual temperature rise of low-temperature air in a sealed space, relative humidity reduction is caused, and a drying effect is effectively formed.

Generally, fruits and vegetables will be stored in the refrigerating chamber 10*a*, so that the relative humidity in the refrigerating chamber 10*a* is higher. An upper portion space of the refrigerating chamber 10*a* may have higher relative humidity than a lower portion space. The arrangement of the drying chamber 40 in the upper portion pace (i.e., an upper half space in the refrigerating chamber 10*a*) in the refrigerating chamber 10*a* is unfavorable for maintaining of a drying state in the drying chamber 40. Therefore, in some embodiments of the present invention, the drying chamber 40 is preferably disposed in the lower portion space in the refrigerating chamber 10*a*. In other words, the drying chamber 40 is disposed in a lower half space in the refrigerating chamber 10*a*.

In some embodiments, a ventilation opening 10*c* is formed in the separation plate between the refrigerating chamber 10*a* and the freezing chamber 10*b*, so as to controllably supply a cooling airflow at the lower portion of the freezing chamber 10*b* to the inside of the drying chamber 40 positioned in the refrigerating chamber 10*a* via the ventilation opening 10*c*. The air-cooled refrigerator further has an air duct assembly disposed at the ventilation opening 10*c*, so that the drying space inside the drying chamber 40 communicates with the freezing chamber 10*b* controllably, and the cooling airflow in the freezing chamber 10*b* further enters the drying space to realize dehumidification and drying.

Preferably, the outer cover housing 200 is disposed on the compartment wall 11 of the refrigerating chamber 10*a* on the side near the freezing chamber 10*b*, and may be fixed through the foaming layer. Further, a plurality of positioning grooves may be formed in the compartment wall 11. A plurality of positioning posts may be correspondingly disposed on the inner cover housing 300, so that the inner cover housing 300 may be positioned on the compartment wall 11. It should be understood that the storage compartment 10 is the refrigerating to chamber 10*a* of the air-cooled refrigerator in the present embodiment.

Further, the outer cover housing 200 may be made of materials such as heat insulation foam. Additionally, in the installing process, the outer cover housing 200 may be firstly attached onto the compartment wall 11 through a sponge strip. The sponge strip and a sealing strip may be attached to an outer side of the outer cover housing. Then, along with the foaming process, the outer cover housing 200 is fixed in the foaming layer and is isolated from a foaming material.

Correspondingly, the inner cover housing 300 may firstly determine an installing position through a plurality of positioning posts and positioning grooves which are correspondingly disposed, and is then fixed to the compartment wall 11 through a connecting member.

In some embodiments, the air duct assembly includes a damper assembly. The damper assembly is disposed inside the outer cover housing 200, so as to communicate or block an air supply path from the air inlet 2010 to the vent 123 controllably. Specifically, the damper assembly includes a damper framework 2032*a* and a rotating damper 2032*b*. The damper framework 2032*a* may be disposed in the external accommodating cavity. The rotating damper 2032*b* is configured to be pivotally installed on an inner side of the damper framework 2032*a*, and is configured to controllably rotate to an open position so as to communicate the air supply path from the air inlet 2010 to the vent 123, and controllably rotate to a closed position so as to block the air supply path from the air inlet 2010 to the vent 123. That is, the damper assembly is configured to be installed in the air duct assembly in an integrally dismountable manner, so as to simplify the assembly of the air duct assembly. Specifically, the outer cover housing 200 may be fixedly installed along with the foaming layer at first. Then, the damper assembly may be directly installed in the external accommodating cavity from an inner side of the refrigerating chamber. Finally, the inner cover housing 300 covers and is buckled on an inner side of the compartment wall 11 of the refrigerating chamber to complete the assembly.

In some embodiments, the outer cover housing 200 has a separation portion 203 protruding and extending from the side wall 201 to the compartment wall 11, so as to separate the external accommodating cavity into an electric cavity 2031 positioned at an upper portion and an air supply cavity 2032 positioned at a lower portion. In the present embodiment, the damper framework 2032*a* is configured to be embedded and installed in the air supply cavity 2032. The air inlet 2010 is disposed in a position of the compartment wall 11 opposite to the air supply cavity 2032. The damper assembly may be an electric control damper assembly. An electric control device 2032*c* in the electric control damper assembly is disposed in the electric cavity 2031.

That is, both the electric cavity 2031 and the air supply cavity 2032 may be completely exposed from an inner side of the vent 123. Therefore, dismounting and mounting of the damper assembly are simplified. Additionally, a rotating ventilation portion of the damper assembly (i.e., the damper framework 2032*a* and the rotating damper 2032*b*) and the electric control portion (i.e., the electric control device 2032*c*) are disposed in two sub accommodating cavities in a manner of being separated from each other. Therefore, the detection, repair or replacement operations of the damper assembly are simpler and more convenient.

Figure 12:
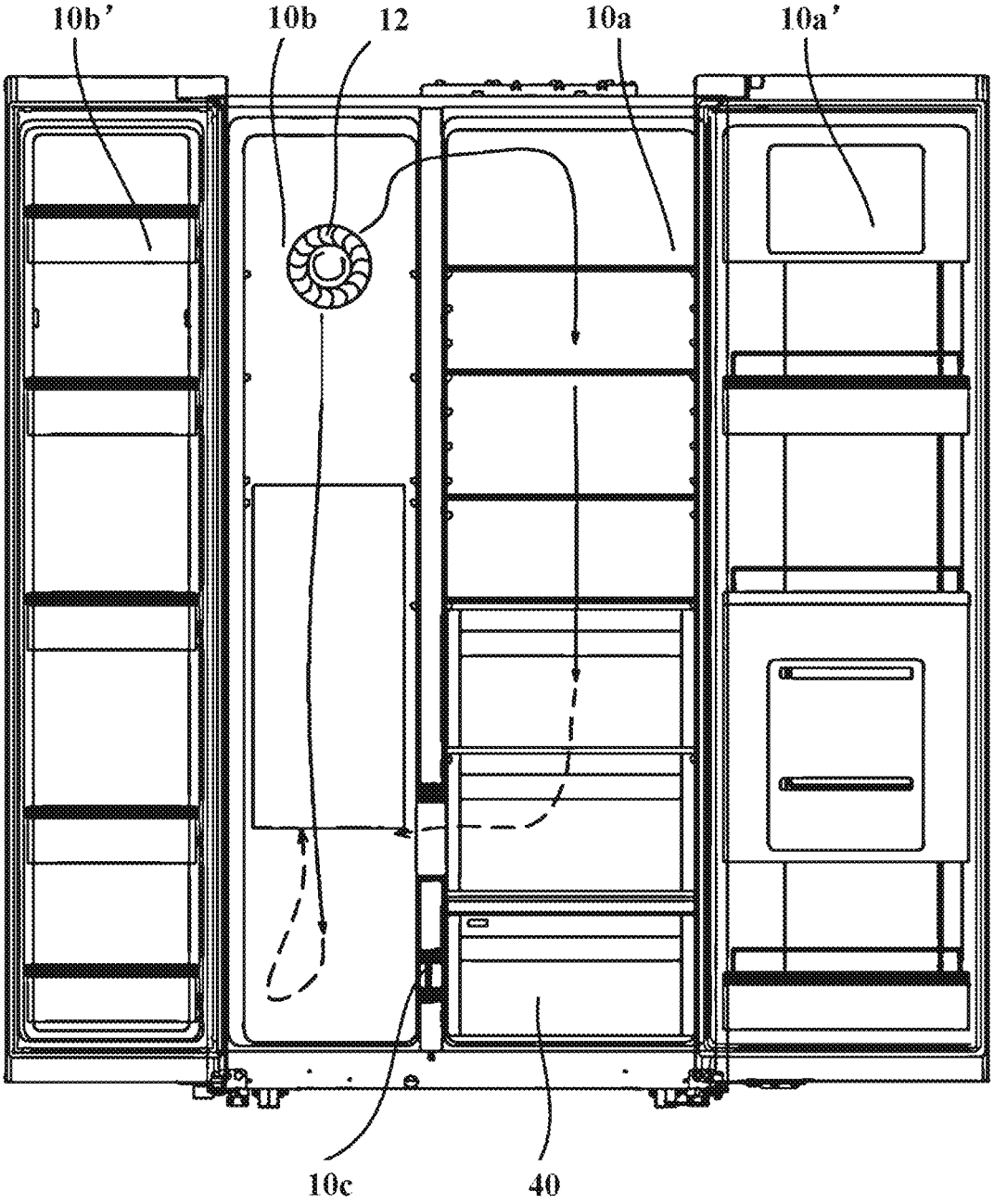
FIG. 12 is a schematic diagram of an air duct system when a rotating damper of an air-cooled refrigerator is closed according to an embodiment of the present invention.
Figure 13:
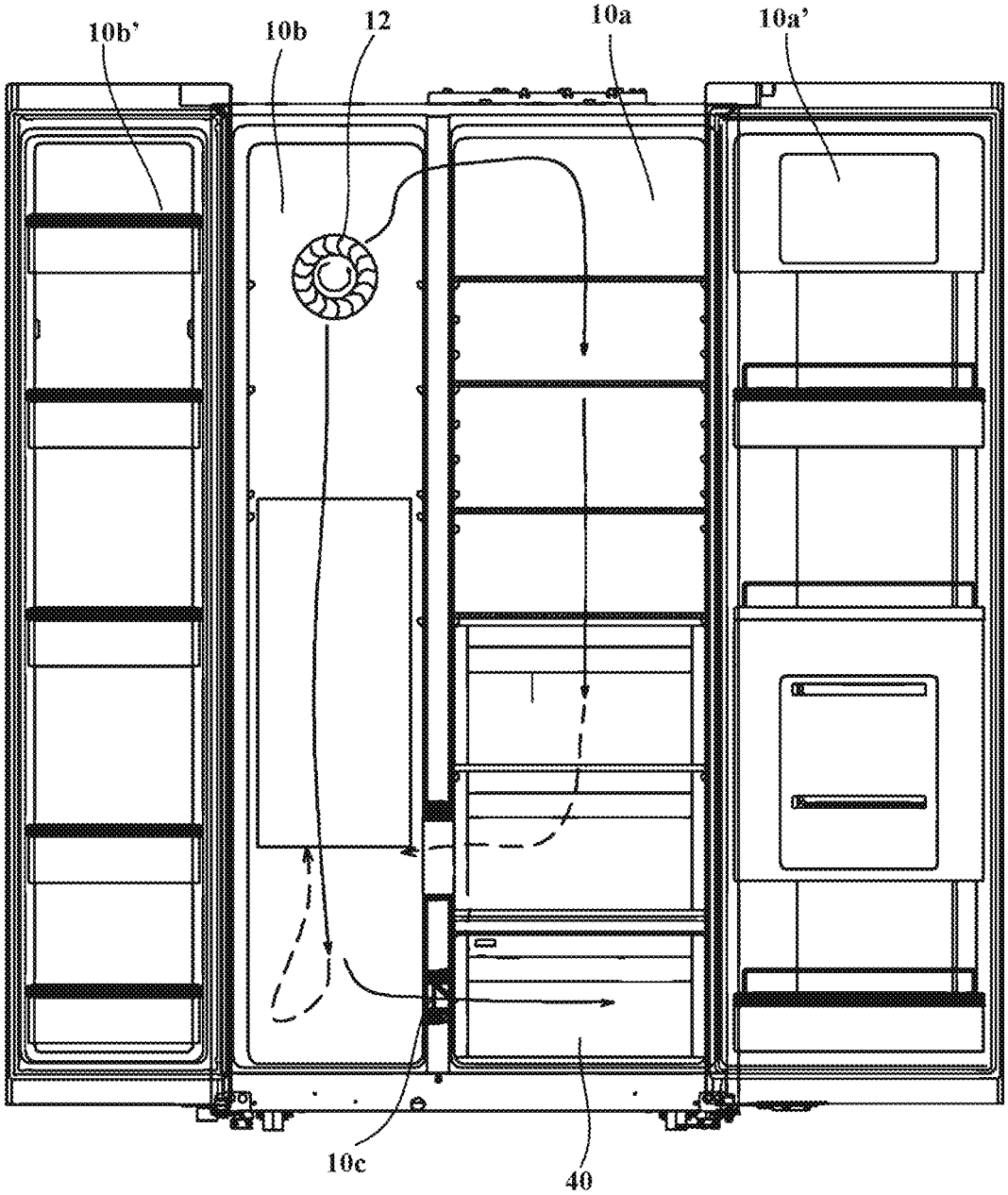
FIG. 13 is a schematic diagram of an air duct system when a rotating damper of an air-cooled refrigerator is opened according to an embodiment of the present invention.

FIG. 12 is a schematic diagram of an air duct system when a rotating damper of an air-cooled refrigerator is closed according to an embodiment of the present invention. FIG. 13 is a schematic diagram of an air duct system when a rotating damper of an air-cooled refrigerator is opened according to an embodiment of the present invention.

Specifically, when the drying chamber 40 does not need air supply, the rotating damper 2032*b* is closed, the cooling airflow inside the freezing chamber 10*b* cannot flow to the drying chamber 40, and for air path flowing directions in the refrigerator, reference may be made to FIG. 12 (solid arrows in the figure show air supply directions, and dotted arrows show air return directions). When the drying chamber 40 needs air supply, the rotating damper 2032*b* is opened, a part of cooling airflow inside the freezing chamber 10*b* flows to the drying chamber 40, and for air path flowing directions in the refrigerator, reference may be made to FIG. 13. The rotating damper 2032*b* may also regulate an opening degree of the air inlet. Specifically, when the drying chamber 40 needs a great air volume, the rotating damper 2032*b* increases the open degree of an air supply opening of the damper assembly. When the drying chamber 40 needs a small air volume, the rotating damper 2032*b* decreases the open degree of the air supply opening of the damper assembly.

Further, a freezing side damper (not shown in the figure) may be disposed on the compartment wall of the transverse side portion of the freezing chamber, so as to control communication and blocking of a flowing path of the cooling airflow in the freezing chamber toward the drying chamber assembly in the refrigerating chamber together with the air duct assembly.

In some embodiments, the inner cover housing 300 may have an air guide plate cover portion 301 disposed corresponding to the outer cover housing 200, and an air outlet cylinder portion 302 perpendicular to the air guide plate cover portion 301 and extending from the back end of the air guide plate cover portion to the middle portion of the back side of the compartment. Further, the air outlet 3020 is formed in a front side of the air outlet cylinder portion 302, so that the air in the internal accommodating cavity flows forward via the air outlet 3020 to enter the compartment. A drying chamber disposed in a manner of being matched with the air duct assembly may be disposed in the compartment. An airflow inlet may be formed in the peripheral wall of the drying chamber, so as to receive an airflow flowing out from the air outlet 3020.

In some embodiments, the drying chamber 40 may be composed of a dismountable drying chamber assembly. Specifically, the drying chamber assembly may consist of a drawer-type sealing container. The drawer-type sealing container includes a drawer body 400, a drawer door 500 and a drawer upper cover 600. The drawer body 400 may have an accommodating cavity for accommodating an object to be stored and a top opening, so as to accommodate the object to be stored. The drawer body 400 may be configured to be pulled out of or pushed into the storage compartment 10 controllably, so as to allow a user to take or place the object. The drawer door 500 may be disposed at a front end of the drawer body 400 and configured to push and pull the drawer body 400. The drawer door 500 may be integrally formed with the drawer body 400, and may be made into a dismountable split form in a clamp connection manner or other connection manners. Particularly, the drawer upper cover 600 may be disposed above the drawer body 400, so as to seal the top opening when the drawer body 400 is completely pushed into the storage compartment 10, and defines a drying space together with the drawer body 400 and the drawer door 500. Further, an airflow inlet 4001 is formed in the drawer body 400 and configured to supply an airflow to the drying space.

Figure 3:
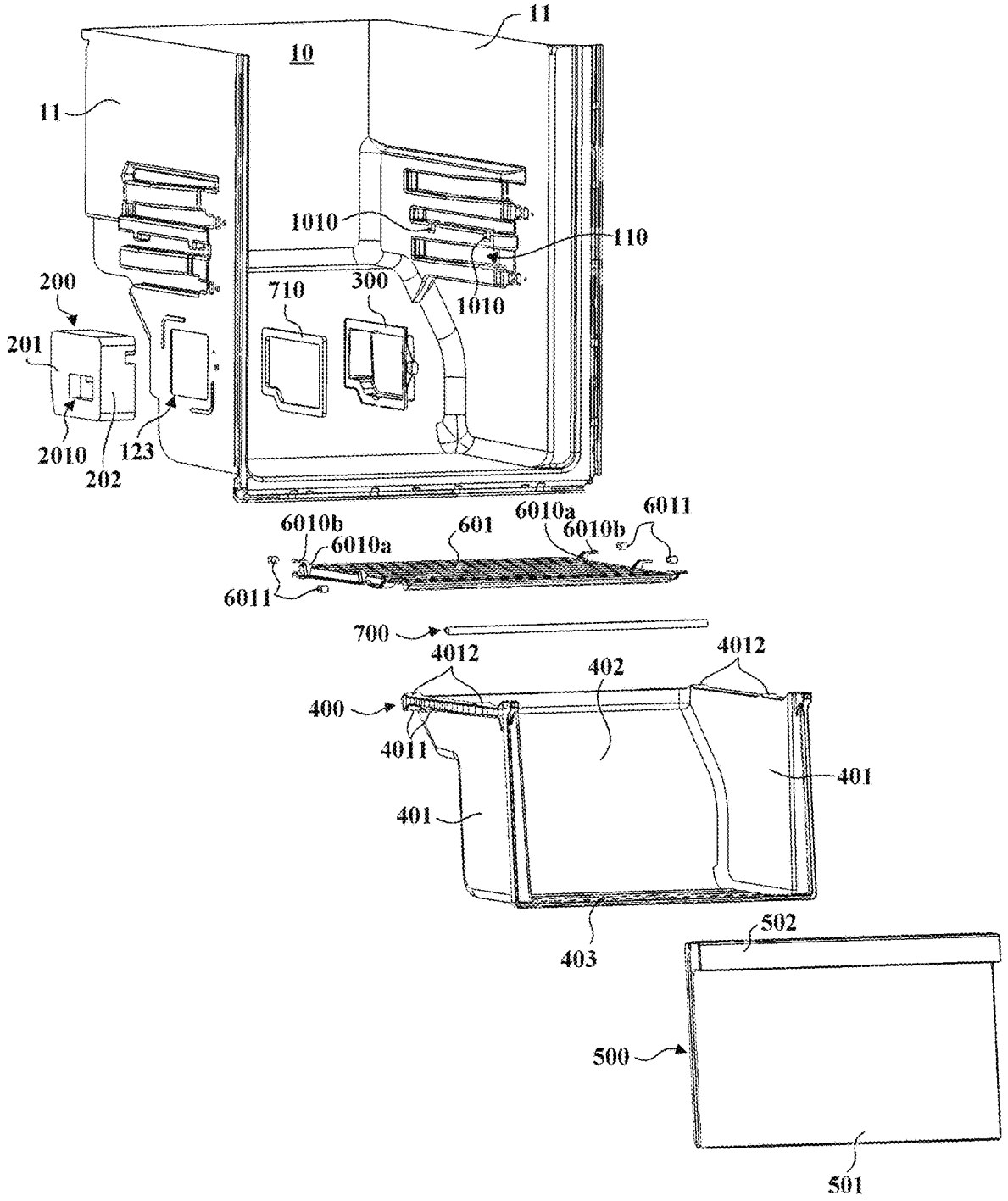
FIG. 3 is a schematic exploded view of the compartment shown in FIG. 2.
Figure 4:
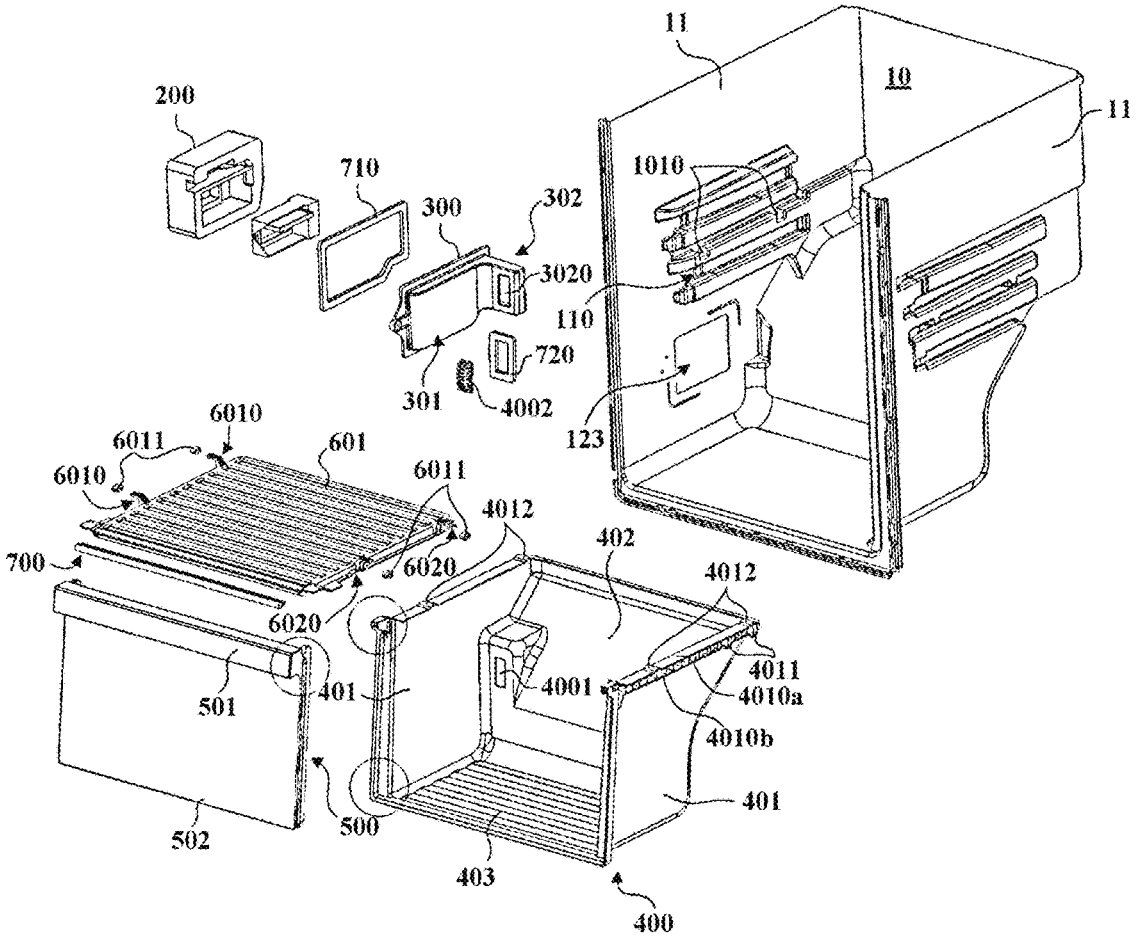
FIG. 4 is a schematic exploded view of the compartment shown in FIG. 2 observed from another angle.

FIG. 3 is a schematic exploded view of the compartment shown in FIG. 2. FIG. 4 is a schematic exploded view of the compartment shown in FIG. 2 observed from another angle.

Referring to FIG. 3 and FIG. 4, the airflow inlet 4001 of the drying chamber for ventilation may be disposed on a back plate 402 of the drawer body 400. Therefore, better cooperation with the air duct assembly may be realized. Specifically, the airflow inlet 4001 may be configured to be right aligned with and abut against the air outlet 3020 when the drawer body 400 is completely pushed into the refrigerating chamber, so as to controllably supply the cooling airflow in the freezing chamber to the drying chamber assembly positioned inside the refrigerating chamber via the air duct assembly.

That is, the inner cover housing 300 guides the cooling airflow from the freezing chamber to the back portion of the refrigerating chamber, so as to supply the cooling airflow to the drying space from the back side to the front side. Further, after the drawer body 400 is completely pushed into the refrigerating chamber, the drawer body 400 abuts against the inner cover housing 300, and independent sealing of the drying space is realized through the airflow inlet 4001 and the air outlet 3020 which are right aligned with each other. It should be noted that, at this time, the independent sealing of the drying space refers to that except controllable communication with the necessary air duct assembly, no other airflow exchange exists.

The drying chamber assembly of the present invention receives the cooling airflow only through the airflow inlet 4001, and air inside the drying chamber assembly is dehumidified and dried in the temperature rise process of the cooling airflow. That is, the drying space always has a relatively great air pressure in the dehumidification and drying process, so that damp air in the refrigerating chamber is prevented from entering the drying space.

In some embodiments, the air duct assembly further includes a first sealing strip 710 and a second sealing strip 720. The first sealing strip 710 is configured to be in an annular shape and disposed at an edge of the air guide plate cover portion 301, so as to seal a gap between the inner cover housing 300 and the compartment wall 11. The second sealing strip 720 may be configured to be in an annular shape, and is disposed on the outer side of the inner cover housing 300 along the edge of the air outlet 3020, so as to seal a gap between the airflow inlet 4001 and the air outlet 3020 when the drawer body 400 is completely pushed into the compartment. Further, an air inlet grille 4002 may be disposed at a back portion of the drawer body 400, and is configured to cover and be buckled on the inner side of the airflow inlet 4001 in a manner of protruding toward the inside of the drawer body 400, so as to prevent solid impurities in the freezing chamber from entering the drying space along with the cooling airflow.

The drying space of the present invention is defined by the drawer body 400, the drawer door 500 and the drawer upper cover 600 which are disposed in a mutually matched manner, and further, the independent drying space is formed through contact sealing of the drawer body, the drawer door and the drawer upper cover. The airflow inlet 4001 is directly formed in the drawer body 400, so as to directly supply a drying airflow to the inside of the drawer body 400 for accommodating the object. A drawer cylinder does not need to be disposed.

Further, the drying chamber assembly of the present invention directly covers and seals the top opening of the drawer body 400 through the drawer upper cover 600, so that the independently sealed drying space is formed inside the drawer body 400. The drying airflow is guided to directly enter the drying space through the airflow inlet 4001 formed in the drawer body 400. Structures such as a drawer cylinder do not need to be additionally disposed, so that the assembly of the drying chamber assembly is simplified, and the manufacturing cost is reduced.

With continuous reference to FIG. 3 and FIG. 4, in some embodiments of the present invention, the drawer body 400 may have a back plate 402, and a bottom plate 403 and two side plates 401 respectively positioned on two transverse sides. The bottom plate and the two side plates are combined with the back plate 402 at the respective back end. Further, two side convex strips 4010 extending in the depth direction are disposed on outer sides of tops of the two side plates 401. A pair of slideways 110 with opposite openings disposed opposite to each other and extending in the depth direction may be formed in the compartment walls 11 on two transverse sides of the storage compartment 10 (i.e., the refrigerating chamber). Specifically, the compartment wall 11 may be an inner liner defining the storage compartment 10 of the refrigerator. The two side convex strips 4010 on the drawer body 400 are configured to be movably embedded and disposed in the pair of slideways 110 respectively. Therefore, pull-out movement and push-in movement of the drawer body 400 relative to the storage compartment 10 are realized. Additionally, a contact area of the drawer body 400 and the drawer upper cover 600 is simultaneously increased by the two side convex strips 4010 on the two side plates 401, and the sealing performance of the drying space is enhanced. That is, the drawer body 400 is slidably disposed in the storage compartment 10 through the side convex strips 4010 disposed thereon, and after the drawer body is pushed into the storage space, the contact area with the drawer upper cover 600 is increased through the side convex strips 4010.

Figure 7:
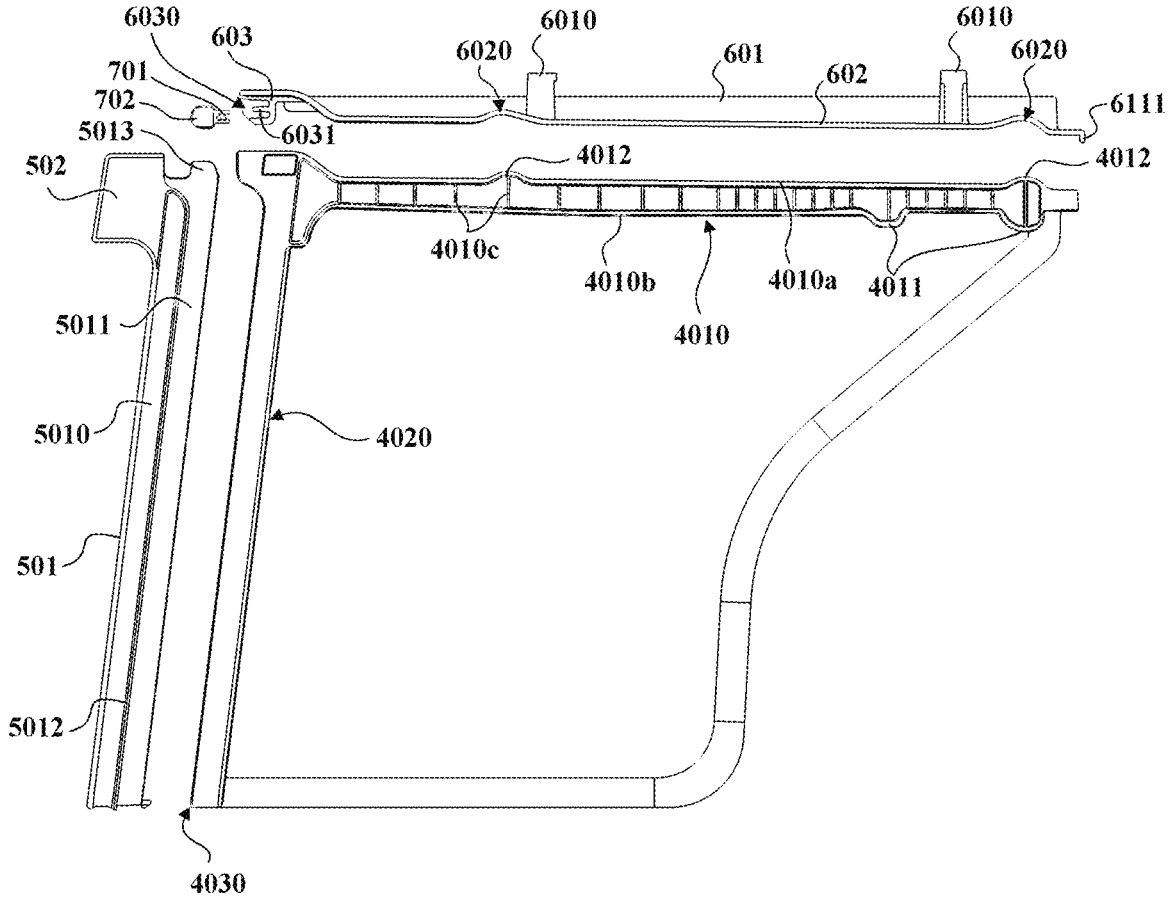
FIG. 7 is a lateral exploded view of a drying chamber assembly according to an embodiment of the present invention.

FIG. 7 is a lateral exploded view of a drying chamber assembly according to an embodiment of the present invention.

Referring to FIG. 7, in some embodiments of the present invention, the side convex strip 4010 may be composed of an upper side strip 4010*a* flush with the top of the side plate 401 and a lower side strip 4010*b* positioned below the upper side strip 4010*a*. Further, a plurality of vertically extending reinforcing ribs 4010*c* are disposed between the upper side strip 4010*a* and the lower side strip 4010*b* in the depth direction at intervals, so as to enhance structure intensity and stability of the side convex strips 4010.

In some embodiments of the present invention, two downward protruding sliding bulges 4011 are disposed in a bottom surface of each of the side convex strips 4010, and the sliding bulges 4011 are continuously in sliding contact with the slideways 110 respectively in the process of pulling the drawer body 400 out of the storage compartment 10 or pushing the drawer body into the storage compartment. The two sliding bulges 4011 on each of the side convex strips 4010 are configured to be disposed at a back portion of the side convex strip 4010 at an interval, and a lowest protruding position of the relatively front sliding bulge 4011 is configured as a plane structure.

That is, the lower side strip 4010*b* may protrude downward to form a plurality of sliding bulges 4011. Specifically, the lower side strip 4010*b* of each of the side convex strips 4010 may protrude to form the two sliding bulges 4011 which are respectively a circular arc sliding bulge 4011 positioned at the back end portion of the side convex strip 4010 and a plane sliding bulge 4011 positioned on a front side of the circular arc sliding bulge 4011. Therefore, contact points of the side convex strips 4010 and the slideways 110 are reduced to reduce sliding friction resistance and ensure stable and smooth movement of the drawer body 400 at the same time.

The drawer upper cover 600 may have a cover plate portion 601 and two side frame strips 602 positioned on two transverse sides of the cover plate portion 601 respectively and extending in the depth direction. Further, the cover plate portion 601 may be configured as a concave-convex structure. Specifically, the cover plate portion 601 may sequentially form transversely extending strip-shaped bulges and strip-shaped depressions in the depth direction at intervals. Therefore, the structure intensity of the cover plate portion 601 is enhanced, and the planeness of the cover plate portion is improved.

Figure 8:
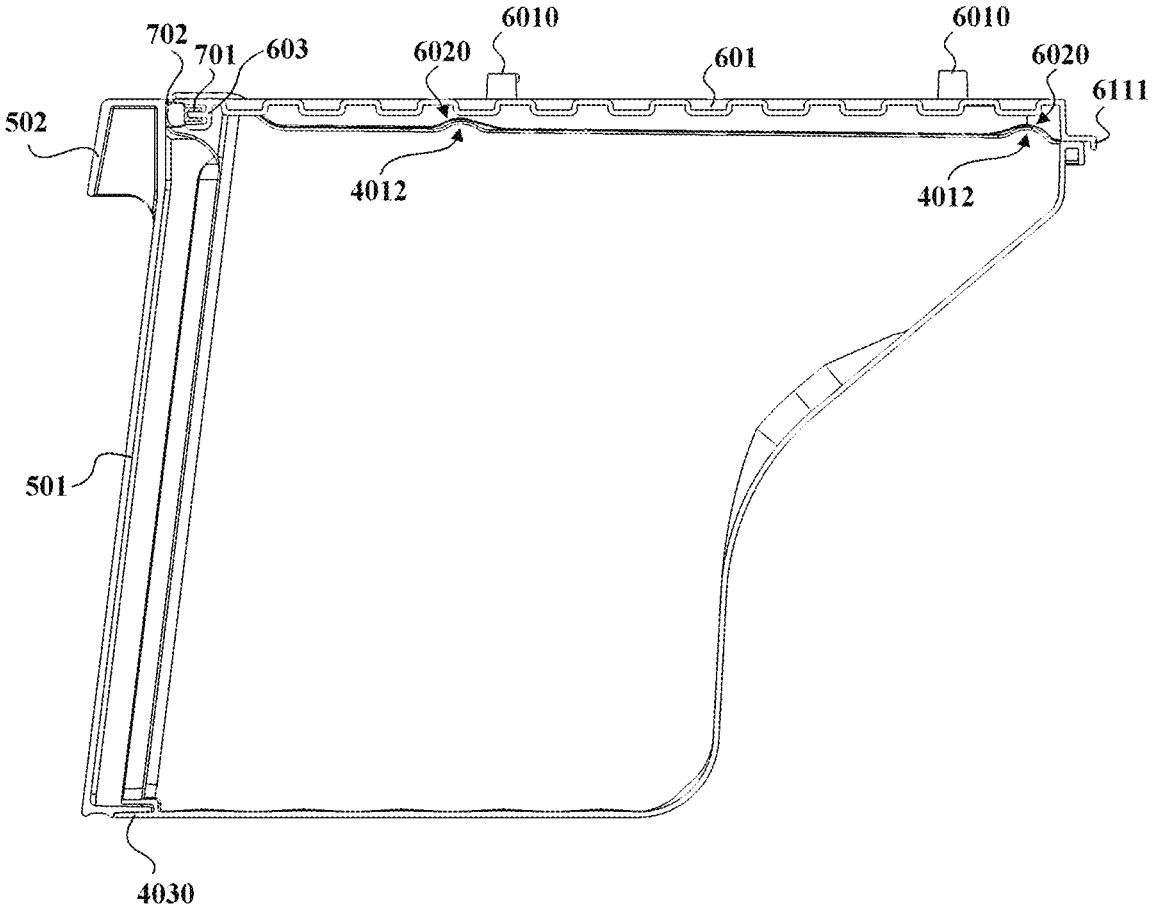
FIG. 8 is a lateral sectional view of a drying chamber assembly according to an embodiment of the present invention.
Figure 9:
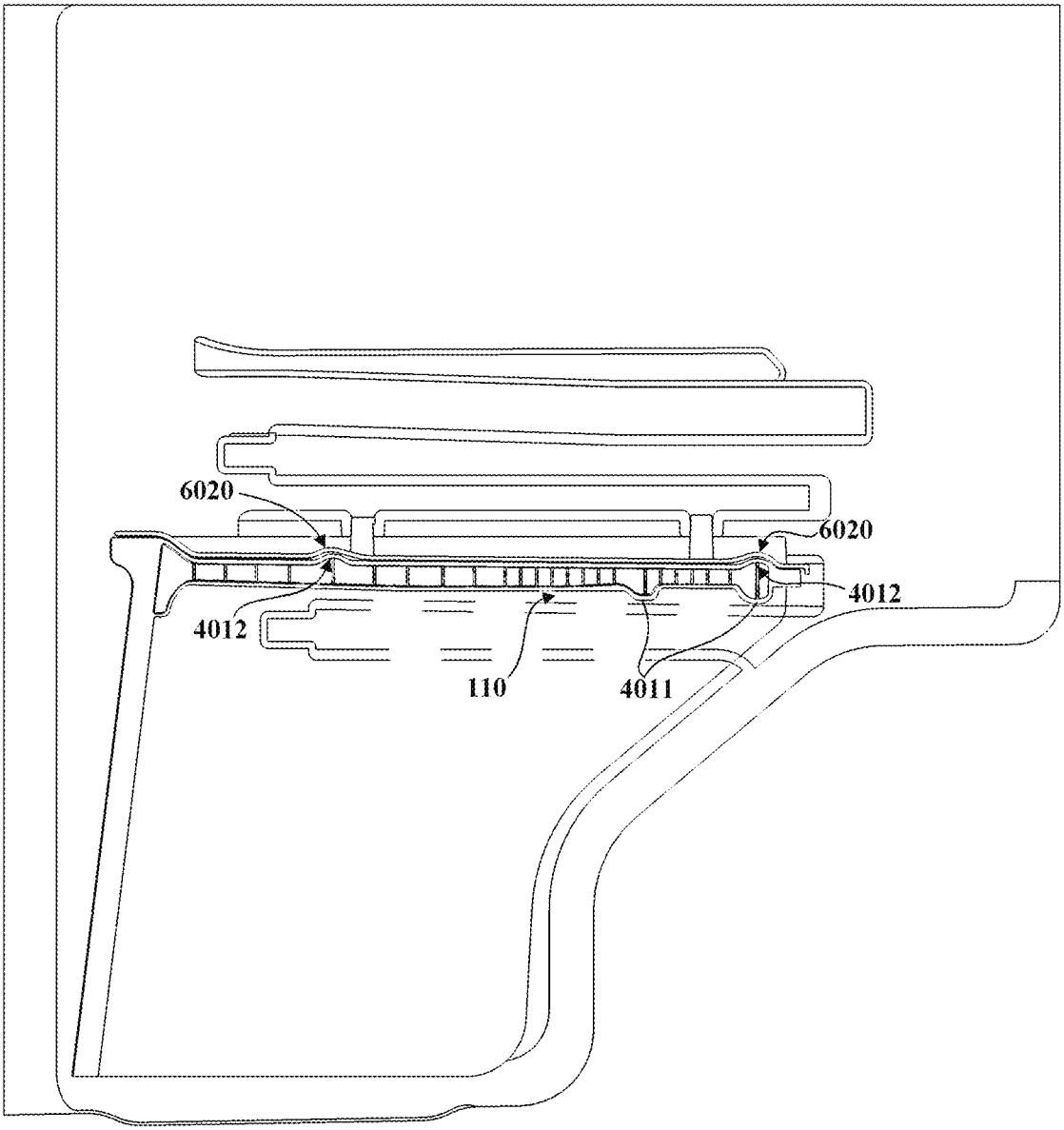
FIG. 9 is a lateral perspective view when a drawer body is in a position of being completely pushed into a compartment according to an embodiment of the present invention.
Figure 10:
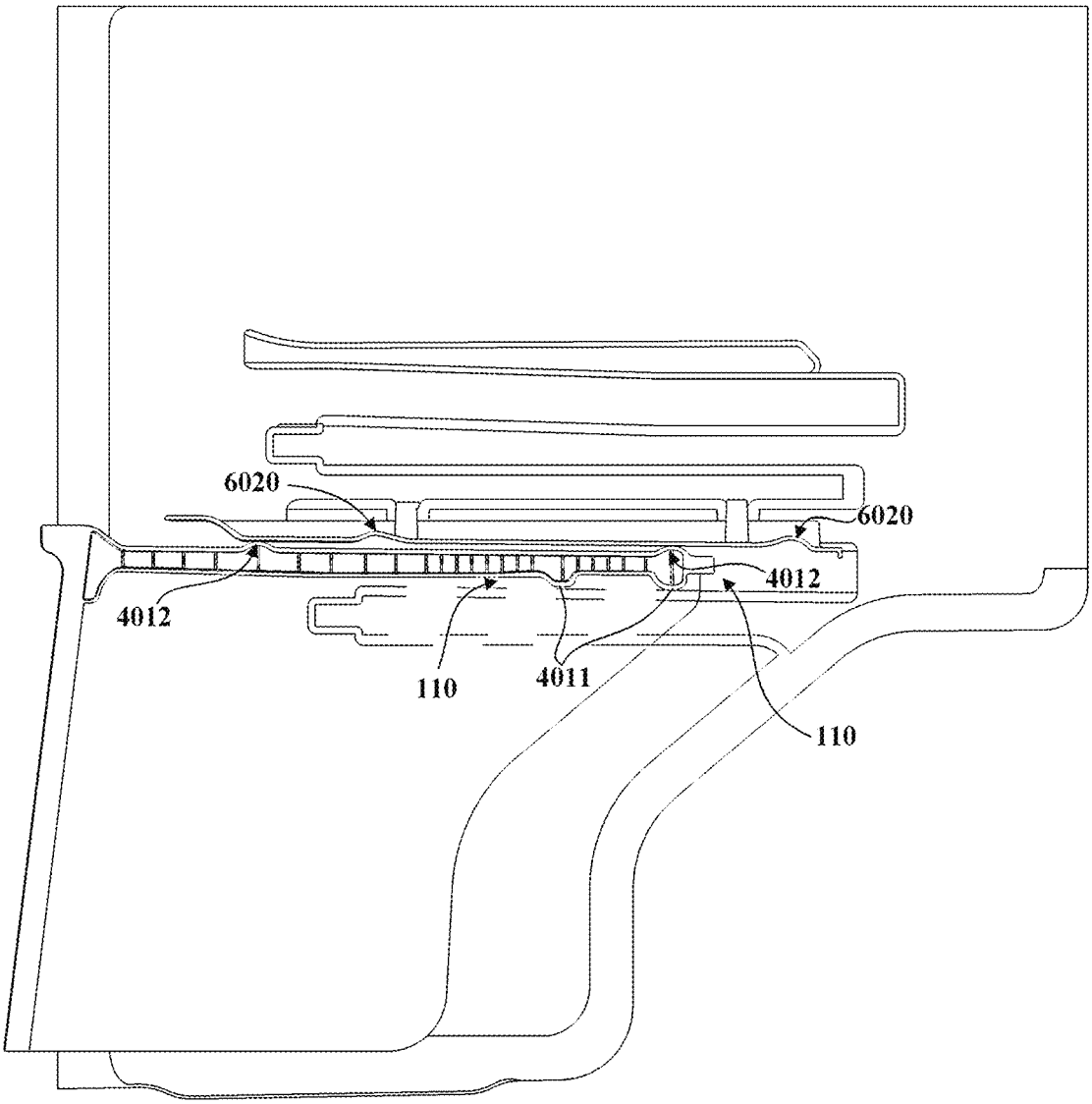
FIG. 10 is a lateral perspective view when a drying chamber assembly is in a position in the process of being pushed into or pulled out of a compartment according to an embodiment of the present invention.

FIG. 8 is a lateral sectional view of a drying chamber assembly according to an embodiment of the present invention. FIG. 9 is a lateral perspective view when a drawer body 400 is in a position of being completely pushed into a compartment of a refrigerator according to an embodiment of the present invention. FIG. 10 is a lateral perspective view when a drying chamber assembly is in a position in the process of being pushed into or pulled out of a compartment of a refrigerator according to an embodiment of the present invention.

In some embodiments of the present invention, the drawer upper cover 600 may be configured to be in lap joint with the compartment wall 11 and move in a vertical direction controllably. Specifically, referring to FIG. 8 to FIG. 10, a plurality of upward recessed positioning depressions 6020 are disposed on a bottom surface of each of the side frame strips 602 of the drawer upper cover 600 respectively. A plurality of upward protruding positioning bulges 4012 are disposed on a top surface of each of the side convex strips 4010 of the drawer body 400 respectively. The plurality of positioning bulges 4012 are configured to be disposed opposite to the plurality of positioning depressions 6020 respectively.

That is, a plurality of plane sections are disposed on the bottom surface of the side frame strip 602 and the top surface of the side convex strip 4010 respectively, so as to realize mutual attachment when the drawer body 400 is completely pushed into the storage compartment 10 to seal the top opening of the drawer body 400. The plurality of positioning depressions 6020 may be formed between the plane sections of the bottom surface of the side frame strip 602. The plurality of positioning depressions 6020 may be correspondingly formed between the plane sections of the top surface of the side convex strip 4010. Therefore, when the drawer body 400 is completely pushed into the storage compartment 10, a region beyond the plane sections may realize sealing on the top opening of the drawer body 400 through the positioning bulges 4012 and the positioning depressions 6020.

Further, the plurality of positioning bulges 4012 and positioning depressions 6020 disposed in one-to-one correspondence may be staggered in the process of pulling the drawer body 400 out of the storage compartment 10 or pushing the drawer body into the storage compartment (referring to FIG. 10). Therefore, the plurality of positioning bulges 4012 abut against a region (which is also the plane section) of the side frame strips 602 positioned at the outer side of the plurality of positioning depressions 6020, and at the same time, the drawer upper cover 600 moves upward. That is, when a user pulls outward or pushes inward the drawer body 400, the drawer upper cover 600 may automatically move upward to reduce a contact area thereof with the drawer body 400 and reduce sliding friction resistance between the drawer body 400 and the drawer upper cover 600.

Additionally, when the drawer body 400 is completely pushed into the storage compartment 10, the plurality of positioning bulges 4012 and positioning depressions 6020 disposed in one-to-one correspondence may recover to an initial right aligned position (referring to FIG. 9). Therefore, the plurality of positioning bulges 4012 are right aligned with the plurality of positioning depressions 6020 respectively. At this time, the positioning bulges 4012 are just positioned in the positioning depressions 6020. The plane sections of the side frame strips 602 are just right aligned with the plane sections on the side convex strips 4010, so that the drawer upper cover 600 moves downward to be attached to an edge of the top opening of the drawer body 400 and seal the opening. Additionally, the positioning bulges 4012 and the positioning depressions 6020 disposed in an aligned manner may further limit the movement of the drawer body 400 in the depth direction, and prevent the drawer body 400 from sliding outward without an external force, together with the self weight of the drawer upper cover 600, thereby ensuring the stability of the sealing effects of the drying chamber assembly. Further, a back end of the drawer upper cover 600 may be provided with a stopping portion 6111, so as to limit the position of the drawer body 400 when the drawer body is completely pushed into the storage compartment 10 and prevent the drawer body 400 from being excessively pushed into the storage compartment 10 and jacking the drawer upper cover 600 upward.

According to the drying chamber assembly of the air-cooled refrigerator of the present invention, the drawer upper cover 600 is configured to be in lap joint with a compartment side wall 201, an additional connection fixing member is not needed, the cost of parts of the drying chamber assembly is further reduced, and at the same time, an installing operation is simplified, and working hours required for installation are reduced. Further, through the drawer upper cover 600 capable of moving vertically along with pushing or pulling of the drawer body 400, the practicability of the drying chamber assembly is greatly improved. Specifically, in practical use, when a user needs to take or place an object in the drawer body 400 by pushing or pulling the drawer body, only an initial acting force needs to be provided by slight force exertion, so that the positioning bulges 4012 are separated from the positioning depressions 6020, the drawer upper cover 600 may be basically separated from the drawer body 400, and more labor may be saved in a subsequent pushing or pulling action. Correspondingly, when the user completes object taking or placement and needs to reset the drawer body 400, a completion degree of the reset action may be clearly fed back to the user through downward falling of the drawer upper cover 600, and the problem that the drying space is not sealed since the reset action is not complete is avoided. Additionally, as mentioned above, the downward falling drawer upper cover 600 may further ensure that the drying chamber assembly maintains continuous sealing.

In some embodiments of the present invention, the number of the positioning depressions 6020 and the number of the positioning bulges 4012 are four respectively, and the four positioning depressions and the four positioning bulges are respectively configured to be disposed opposite to each other in pairs. Particularly, depression center sections of the positioning depressions 6020 have the same curvature as bulge center sections of the positioning bulges 4012. That is, the positioning bulges 4012 and the positioning depressions 6020 may be configured to be roughly in an arc shape. The radians of arc top sections (corresponding regions of the positioning depressions 6020 may also be called as arc bottom sections) of a matched group of the positioning bulges 4012 and the positioning depressions 6020 are approximately identical, so that the center sections of the positioning bulges 4012 and the center sections of the positioning depressions 6020 are attached.

Further, a curvature of depression edge sections positioned on front and back sides of the depression center sections is less than a curvature of bulge edge sections positioned on front and back sides of the bulge center sections. That is, the positioning depressions 6020 are gentler than the positioning bulges 4012, so that it is convenient for the positioning bulges 4012 to move out of and into the positioning depressions 6020 conveniently. Additionally, in the present embodiment, shielding portions may be formed on inner sides of the positioning depressions 6020 and the positioning bulges 4012, so as to ensure the sealing effects of the sections with different curvatures.

In some embodiments, the positioning bulges 4012 may be formed on the upper side strips 4010*a*. The two positioning bulges 4012 on each of the upper side strips 4010*a* may be respectively positioned at a back end portion of the side convex strip 4010 and a front portion of the side convex strip 4010. Therefore, an acting force between the drawer upper cover 600 and the drawer body 400 is more uniformly dispersed at a front portion and a back portion of the whole drawer assembly at a starting moment of pulling out the drawer body 400. Additionally, in the process of pulling out the drawer body 400, when the positioning bulges 4012 positioned at the back portion move to positions below the positioning depressions 6020 positioned at the front portion, the drawer upper cover 600 may fall down. At this time, the exposed top opening of the drawer body 400 has provided a sufficient space for a user to take or place the object. The downward falling drawer upper cover 600 may thus prevent the drawer body 400 from being excessively pulled out, and operation and use by the user are convenient.

In some embodiments of the present invention, four grooves 1010 with upward openings may be formed in the compartment wall 11 and configured to be disposed opposite to each other in pairs above the pair of slideways 110. Strip-shaped inward bulges may be formed on inner liners on two transverse sides of the storage compartment 10. The bulges may be similar to lap joint convex strips formed in a general storage compartment 10 of a refrigerator and configured to be in lap joint with storage plates. Downward depressions may be respectively formed at front portions and back portions of the strip-shaped bulges on each side to form the grooves 1010.

The strip-shaped bulges and the grooves 1010 formed in the strip-shaped bulges are all positioned in the same horizontal plane, and are symmetrical with respect to a vertical center surface of the storage compartment 10, so as to ensure the horizontal arrangement of the drawer upper cover 600 in lap joint with the strip-shaped bulges and the grooves. Further, the strip-shaped bulge may have a certain thickness in a height direction, so that the grooves 1010 are enabled to have a sufficient depth in the height direction, and the drawer upper cover 600 may vertically move in a smaller range. That is, the drawer upper cover 600 is enabled not to be separated from the grooves 1010 in an upward moving process.

In some embodiments of the present invention, left and right transverse side ends of the drawer upper cover 600 extend outward respectively to form four lap joint portions 6010, and the lap joint portions 6010 are configured to extend upward slantways from the transverse side end respectively and then extend outward horizontally to be in lap joint with the four grooves 1010 respectively. That is, the lap joint portions 6010 have base portions 6010*a* extending upward slantways from the transverse side end of the drawer upper cover 600. Lower is ends of the base portions 6010*a* may be fixedly connected with a side surface and an upper surface of the drawer upper cover 600 at the same time so as to enhance its structure intensity. Extending top ends of the base portions 6010*a* of the four lap joint portions 6010 are all positioned in the same height plane, and extend toward the outer side of the drawer upper cover 600 to form horizontal lap joint plates 6010*b*. Further, a sleeving ring 6011 may be sleeved over the lap joint plate 6010*b* of each of the lap joint portions 6010, so as to buffer impact when the drawer upper cover 600 falls down. The sleeving rings 6011 may be made of elastic materials such as rubber.

In some embodiments of the present invention, the drawer cover plate has a front frame strip 603 positioned at a front end of a cover plate portion 601 and extending in a transverse direction, and the front frame strip 603 is configured to have a strip-shaped installing groove 6030 with a forward opening.

Figure 11:
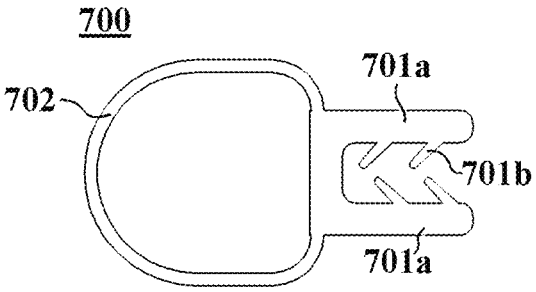
FIG. 11 is a schematic lateral view of a drawer sealing strip according to an embodiment of the present invention.

FIG. 11 is a schematic lateral view of a drawer sealing strip 700 according to an embodiment of the present invention.

Referring to FIG. 11, the drying chamber assembly may further include the drawer sealing strip 700. The drawer sealing strip 700 is configured to be installed in the strip-shaped installing groove 6030, so as to fall down along with the drawer upper cover 600 when the drawer body 400 is completely pushed into the storage compartment 10, and abut against an inner side of the drawer door 500. The drawer sealing strip may be made of elastic materials.

Further, a horizontally extending installing plate 6031 may be disposed in the installing groove 6030, so that the cross section of the front frame strip 603 is roughly in an E shape. The drawer sealing strip 700 may include a sealing strip installing portion 701, configured to be connected to the installing plate 6031 in a clamping way, and a sealing strip abutting portion 702 positioned at a front side of the sealing strip installing portion 701. The sealing strip abutting portion 702 is configured to be in a hollow tubular shape. One side of the sealing strip abutting portion connected with the sealing strip installing portion 701 is configured as a plane, and one side of the sealing strip abutting portion abutting against the drawer door 500 is in an arc shape. That is, the sealing strip abutting portion 702 has a roughly D-shaped cross section. After the drawer body 400 is completely pushed into the storage compartment 10, the sealing strip abutting portion 702 is extruded by the drawer upper cover 600 and the drawer door 500 and seals a gap between the drawer door 500 and the drawer body 400 and between the drawer door 500 and the drawer upper cover 600. The sealing strip installing portion 701 is in a groove 1010 shape with a backward opening. That is, the sealing strip installing portion has two parallel plate-shaped installing strips 701*a*. Inner sides of the two plate-shaped installing strips 701*a* may be provided with a plurality of inclined anti-slip strips 701*b*. The anti-slip strips 701*b* are configured to extend slantways from an inner side surface of each installing strip 701*a* and from the located side of an opening of the sealing strip installing portion 701 to the located side of the sealing strip abutting portion 702, so that the sealing strip installing portion 701 is connected onto the installing plate 6031 in the installing groove 6030 in a clamping way, and is prevented from being separated from the installing plate 6031.

Figure 4A:
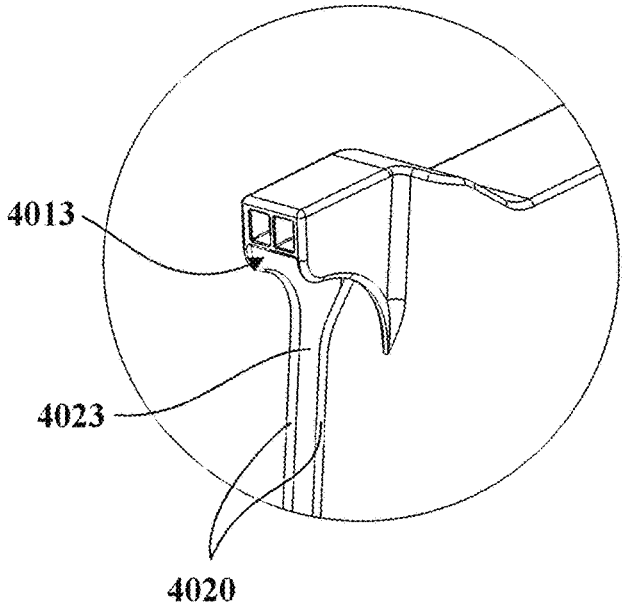
FIG. 4*a* is a schematic locally-enlarged view of the drying chamber assembly shown in FIG. 4, wherein a clamp connection structure of an upper portion of a front end of a drawer body is shown.
Figure 4B:
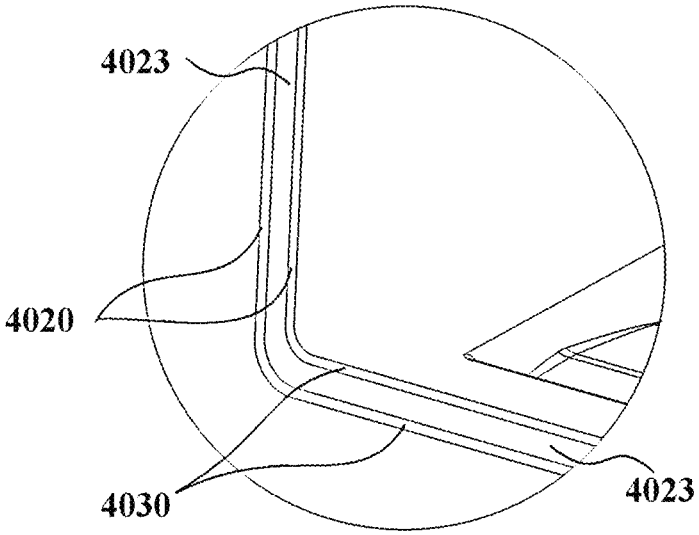
FIG. 4*b* is a schematic locally-enlarged view of the drying chamber assembly shown in FIG. 4, wherein a clamp connection structure of a lower portion of a front end of a drawer body is shown.
Figure 4C:
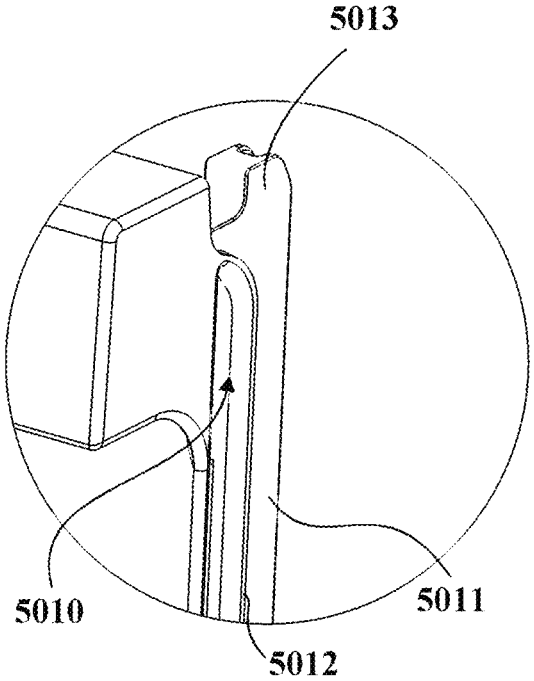
FIG. 4*c* is a schematic locally-enlarged view of the drying chamber assembly shown in FIG. 4, wherein a clamp connection structure of a drawer door is shown.
Figure 5:
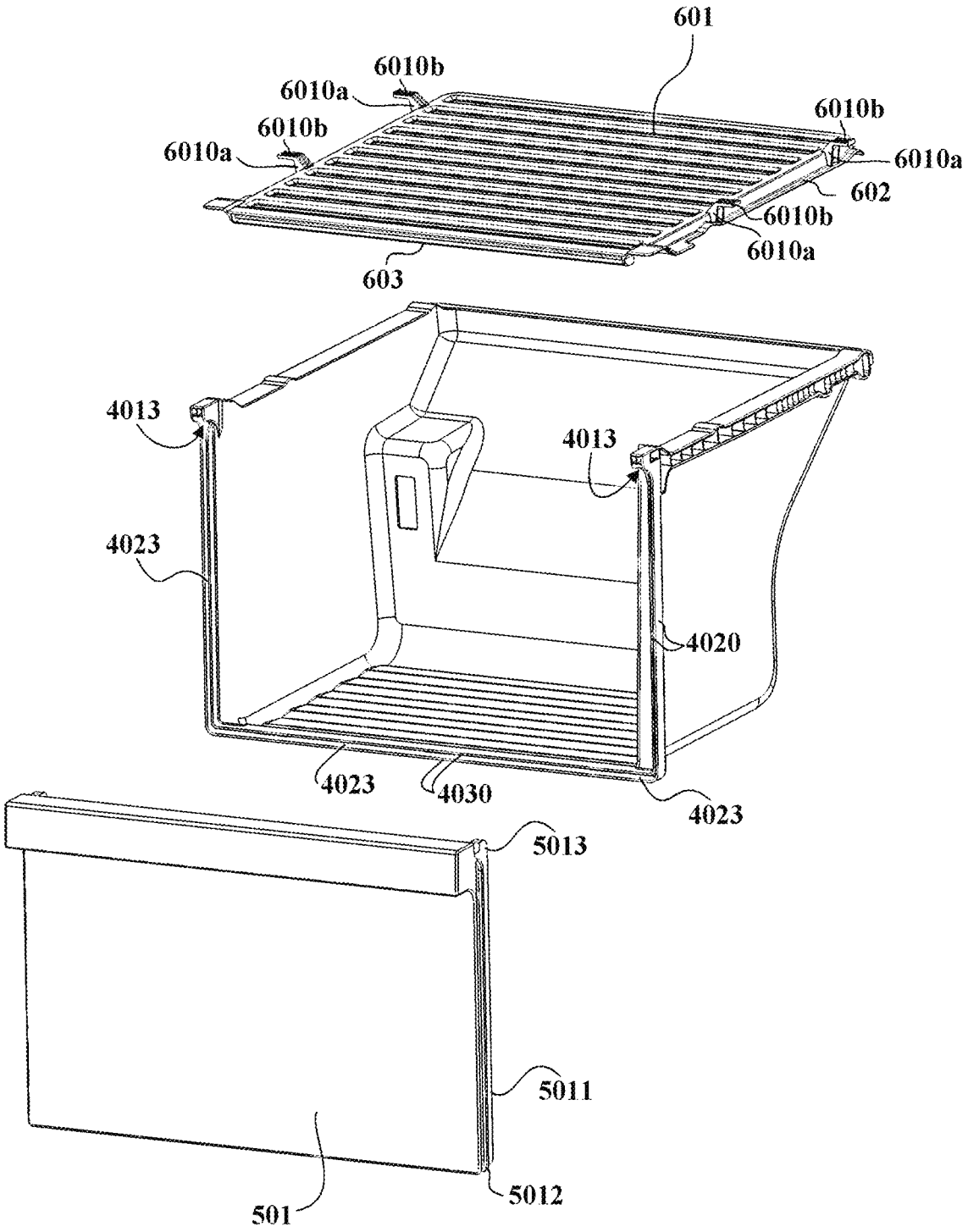
FIG. 5 is a schematic exploded view of a drying chamber assembly according to an embodiment of the present invention.
Figure 6:
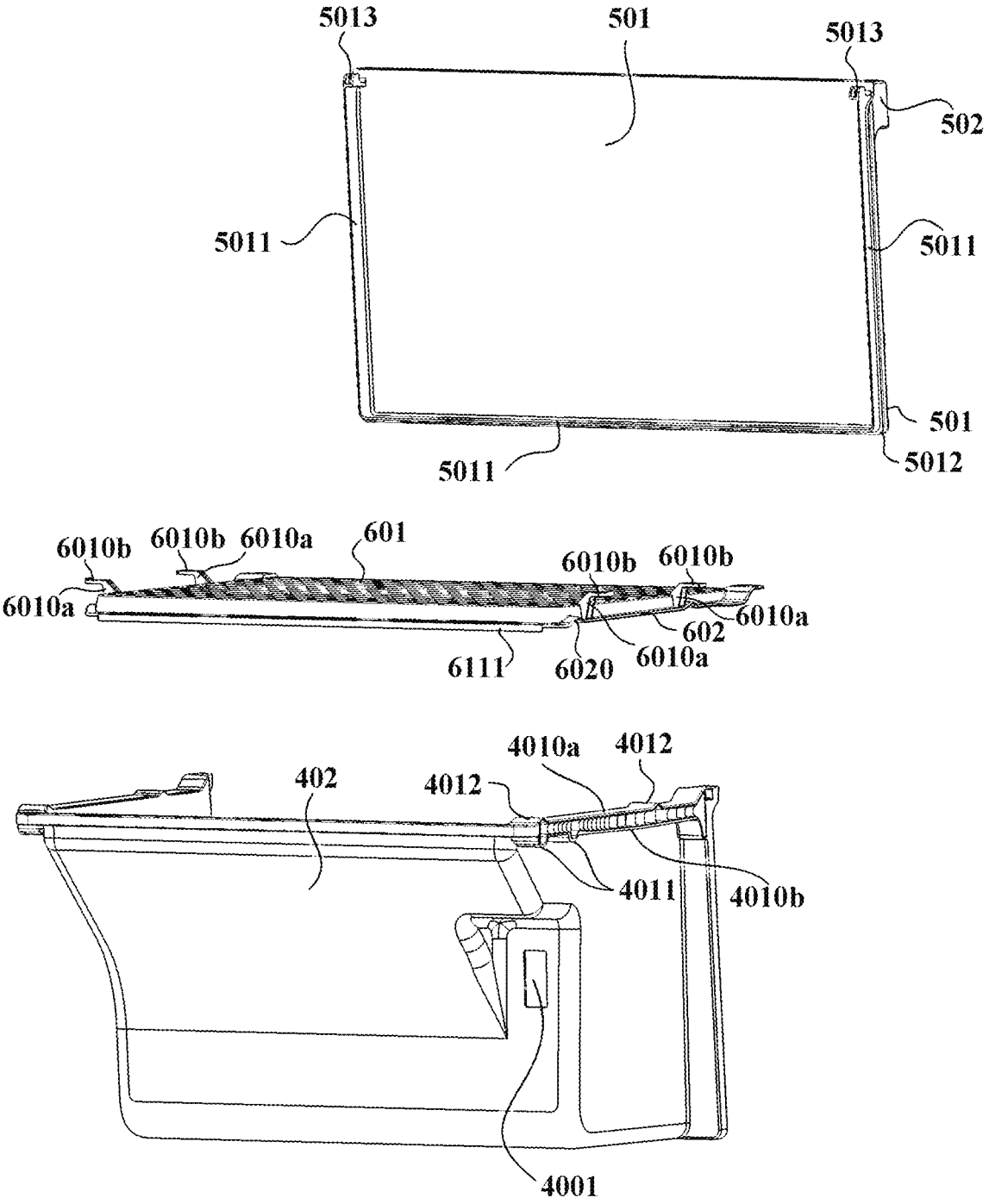
FIG. 6 is a schematic exploded view of a drying chamber assembly observed from another angle according to an embodiment of the present invention.

Referring to FIG. 4*a* to FIG. 4*c*, in some embodiments, a front end of the side plate 401 of the drawer body 400 has a vertically extending front convex strip 4020 protruding toward the outer side. The front convex strip 4020 is configured to have its upper end be fixedly connected with a front end of the side convex strip 4010 on the outer side of an upper end of the side plate 401. In some further embodiments, the front convex strip 4020 and the side convex strip 4010 may be integrally formed with the side plate 401, so as to enhance the structure intensity. In further embodiments, a front end of the bottom plate 403 of the drawer body 400 may protrude forward to form a bottom convex strip 4030. The bottom convex strip 4030, the front convex strip 4020 and the side convex strip 4010 may be integrally formed with the side plate 401 jointly.

In some embodiments, a continuous clamp groove 4023 with a forward opening may be formed in front end surfaces of the front convex strip 4020 and the bottom convex strip 4030. The drawer door 500 may include a door plate body 501 and a door handle 502 positioned on an upper portion of an outer surface of the door plate body 501. An inner side surface of the door plate body 501 may protrude outward to form a clamp strip 5011, and the clamp strip 5011 is configured to continuously extend along two side edges and a bottom edge of the drawer door 500. Therefore, the drawer door 500 can be directly connected and installed at the front end of the drawer body 400 through the clamp strip 5011 in a clamping way.

Further, a plurality of wedge-shaped bulges may be disposed on the clamp strip 5011 positioned at a lower portion of the inner surface of the door plate body 501 at intervals. A plurality of through holes may be correspondingly formed in a groove wall of the clamp groove 4023 positioned on the bottom convex strip 4030. Therefore, when the drawer door 500 is installed at the front end of the drawer body 400, the plurality of wedge-shaped bulges on the clamp strip 5011 may be connected to the through holes on the clamp groove 4023 in a clamping way, and the drawer door 500 is prevented from being separated from the drawer body 400. Specifically, the plurality of wedge-shaped bulges may be disposed on a bottom surface of the clamp strip 5011. The plurality of through holes may be disposed on the lower side groove wall of the clamp groove 4023, so as to ensure the sealing performance of the drying space.

In further embodiments, stopping strips 5012 are formed on outer surfaces of the clamp strips 5011 positioned on two sides of the door plate body 501. The stopping strip 5012 is configured to just abut against the front end surface of the groove wall of the clamp groove 4023 when the clamp strip 5011 is inserted into the clamp groove 4023, so as to enhance connection stability of the clamp strip 5011 and the clamp groove 4023. Additionally, the stopping strip 5012 may further form a concave handle 5010 together with part of the clamp strip 5011 and an edge region of the door plate body 501 positioned on a transverse outer side of the clamp strip 5011, so that it is convenient for a user to hold, push and pull the drawer door 500.

In some embodiments, upper end portions of the clamp strips 5011 positioned on two sides of the door plate body 501 have clamp blocks 5013 disposed away from the door plate body 501. That is, a space is left between the clamp block 5013 and the door plate body 501. The clamp block 5013 is configured to protrude from the upper end portion of the clamp strip 5011 to the transverse center surface of the door plate body 501. Correspondingly, a clamp connection cavity 4013 may be formed above the front convex strips 4020 on two sides of the drawer body 400, and is configured to enable the clamp block 5013 to extend into the clamp connection cavity from bottom to top and be connected into the clamp connection cavity in a clamping way. Therefore, connection stability and firmness between the drawer door 500 and the drawer body 400 is further improved. Additionally, through embedded connection of the clamp strip 5011 and the clamp groove 4023, the drying chamber assembly of the present invention avoids gaps between the drawer door 500 and the drawer body 400, and enhances the sealing performance of the drying chamber assembly.

Referring to FIG. 7 and FIG. 8, in some embodiments of the present invention, the drawer door 500 has an inclination angle when being installed at the front end of the drawer body 400. Specifically, the front end surfaces of the two side plates 401 of the drawer body 400 are configured to extend backward slantways from bottom to top, so that the drawer door 500 is backward slantways when being installed on the drawer body 400. Further, the transversely extending door handle 502 is formed on the outer side of the upper end of the drawer door 500 and configured to enable a front surface of the door handle 502 and the bottom of the door plate body 501 to be roughly positioned on the same vertical plane. That is, a bottom space inside the drawer body 400 is greater than top spaces of the drawer body, and objects inside the bottom space can be placed in a stacked manner conveniently. Additionally, the door handle 502 may provide a holding portion spanning across the transverse width of the whole drawer door 500, so that it is convenient for the user to pull the drawer body 400. At the same time, through the drawer door 500 disposed in a backward inclined manner, interference with a door body for opening and closing the storage compartment 10 may be further avoided.

It should be appreciated by those skilled in the art that although the air duct assembly in any of the above embodiments is particularly applicable to air supply to the drying chamber in the air-cooled refrigerator, it is also applicable to other storage devices. Similarly, the drying chamber assembly and the air duct assembly may also be jointly disposed in some other storage devices requiring controlled ventilation in a cooperative manner. The application of the air duct assembly and the drying chamber assembly in the air-cooled refrigerator shall not be regarded as limitation of the application thereof in other use environments.

Hereto, it should be appreciated by those skilled in the art that although a plurality of exemplary embodiments of the present invention have been shown and described in detail herein, many other variations or modifications in accordance with the principles of the present invention can be directly determined or derived from the disclosure of the present invention without departing from the spirit and scope of the present invention. Therefore, the scope of the present invention should be understood and deemed to cover all such other variations or modifications.

What is claimed is:

1. An air duct assembly, configured to supply air to a compartment, and comprising:

an outer cover housing, configured to be fixed to an outer side of a compartment wall defining the compartment, an external accommodating cavity being defined inside the outer cover housing; and an inner cover housing, configured to be disposed opposite to the outer cover housing on an inner side of the compartment wall, an internal accommodating cavity being defined inside the inner cover housing, wherein an air inlet is formed in the outer cover housing, so as to allow external air to enter the external accommodating cavity via the air inlet, a vent is formed in the compartment wall, so that the external accommodating cavity communicates with the internal accommodating cavity, and an air outlet is formed in the inner cover housing, so as to supply the air in the internal accommodating cavity to an inside of the compartment; wherein the air duct assembly is disposed on the compartment wall positioned at a transverse side portion of the compartment;

the inner cover housing has an air guide plate cover portion disposed corresponding to the outer cover housing, and an air outlet cylinder portion perpendicular to the air guide plate cover portion and extending from a back end of the air guide plate cover portion to a middle portion of a back side of the compartment; and the air outlet is formed in a front side of the air outlet cylinder portion, so that air in the internal accommodating cavity flows forward via the air outlet to enter the compartment.

2. The air duct assembly according to claim 1, wherein the outer cover housing has a side wall provided with the air inlet and a side peripheral wall vertically extending from a peripheral side edge of the side wall, and the outer cover housing is configured to shield the vent from the outer side of the compartment wall; and a projection of an outer surface of the side peripheral wall on a located plane of the compartment wall is positioned beyond the vent, and a projection of an inner surface of the side peripheral wall on the located plane of the compartment wall falls in the vent.

3. The air duct assembly according to claim 2, further comprising:

a damper assembly, disposed inside the outer cover housing, so as to communicate or block an air supply path from the air inlet to the vent controllably, and the damper assembly comprises:

a damper framework, disposed in the external accommodating cavity; and a rotating damper, pivotally installed on an inner side of the damper framework, and configured to controllably rotate to an open position so as to communicate the air supply path from the air inlet to the vent, and controllably rotate to a closed position so as to block the air supply path from the air inlet to the vent.

4. The air duct assembly according to claim 3, wherein the outer cover housing has a separation portion protruding and extending from the side wall to the compartment wall, so as to separate the external accommodating cavity into an electric cavity positioned at an upper portion and an air supply cavity positioned at a lower portion;

the damper framework is configured to be embedded and installed in the air supply cavity, and the air inlet is disposed in a position of the compartment wall opposite to the air supply cavity; and the damper assembly is an electric control damper assembly, and an electric control device in the electric control damper assembly is disposed in the electric cavity.

5. The air duct assembly according to claim 1, wherein a drawer body is disposed in the compartment, so as to accommodate an object to be stored in the compartment, and is configured to be pulled out of or pushed into the compartment controllably; and an airflow inlet is formed in a back plate of the drawer body and configured to be right aligned with and abut against the air outlet when the drawer body is completely pushed into the compartment.

6. The air duct assembly according to claim 5, wherein the drawer body has an upward top opening; and a drawer upper cover is disposed above the drawer body, so as to seal the top opening when the drawer body is completely pushed into the compartment.

7. The air duct assembly according to claim 5, further comprising:

a first sealing strip, configured to be in an annular shape and disposed at an edge of the air guide plate cover portion, so as to seal a gap between the inner cover housing and the compartment wall; and a second sealing strip, configured to be in an annular shape and disposed on an outer side of the inner cover housing along an edge of the air outlet, so as to seal a gap between the airflow inlet and the air outlet when the drawer body is completely pushed into the compartment.

8. The air duct assembly according to claim 5, wherein an air inlet grille is disposed at a back portion of the drawer body and configured to cover and be buckled on an inner side of the airflow inlet in a manner of protruding toward the inside of the drawer body.

9. An air-cooled refrigerator, comprising a freezing chamber, a refrigerating chamber, and the air duct assembly according to claim 1, wherein the refrigerating chamber is a compartment, and the air duct assembly is disposed on a compartment wall positioned at a transverse side portion of the refrigerating chamber;

the air-cooled refrigerator further comprises a drying chamber assembly disposed in a lower portion space inside the refrigerating chamber, the drying chamber assembly comprises a drawer body configured to store an object to be stored and having an upward opening, and a drawer upper cover disposed above the drawer body;

the drawer body is configured to be pulled out of or pushed into the refrigerating chamber controllably, and the drawer upper cover seals the opening when the drawer body is completely pushed into the refrigerating chamber;

an airflow inlet is formed in a back plate of the drawer body and configured to be right aligned with and abut against an air outlet when the drawer body is completely pushed into the refrigerating chamber; and an air inlet is configured to communicate with the freezing chamber controllably, so as to controllably supply a cooling airflow in the freezing chamber to the drying chamber assembly positioned inside the refrigerating chamber via the air duct assembly.

* * * * *